United States Patent [19]

Röck et al.

[11] Patent Number: 4,692,035

[45] Date of Patent: Sep. 8, 1987

[54] EXTENSION PULL-OUT GUIDE ASSEMBLY FOR DRAWERS

[75] Inventors: Erich Röck, Höchst; Felix Schwärzler, Hohenems, both of Austria

[73] Assignee: Julius Blum Gesellschaft m.b.H., Höchst, Austria

[21] Appl. No.: 860,485

[22] Filed: May 7, 1986

[30] Foreign Application Priority Data

May 9, 1985 [AT] Austria ..... 1394/85

[51] Int. Cl.[4] ..... F16C 29/00; A47B 88/00

[52] U.S. Cl. ..... 384/18; 384/21; 312/348

[58] Field of Search ..... 384/18–22; 312/348

[56] References Cited

U.S. PATENT DOCUMENTS

| | | | |
|---|---|---|---|
| 2,600,598 | 6/1952 | Woodin | 384/19 |
| 3,298,768 | 1/1967 | Vogt | 312/348 X |
| 3,743,366 | 7/1973 | Tazaki | 384/18 |
| 3,746,418 | 7/1973 | Barber, Jr. | 312/348 |
| 4,121,878 | 10/1978 | Lokker | 312/348 X |
| 4,367,906 | 1/1983 | Röck | 312/348 X |
| 4,537,450 | 8/1985 | Baxter | 384/18 |

*Primary Examiner*—Stuart S. Levy
*Assistant Examiner*—Thomas R. Hannon
*Attorney, Agent, or Firm*—Wenderoth, Lind & Ponack

[57] ABSTRACT

An extension pull-out guide assembly for a drawer includes a supporting rail on the side of the furniture body, a center rail and a pull-out rail on each side of the drawer. The supporting rail has one or two resilient stops of resilient material and a rigid stop which cannot be overrun by a roller of the center rail. A lower horizontal flange of the supporting rail is provided at the outer edge thereof with a vertical flange. An opening is provided in the vertical flange in front of rigid stop. When the center rail is extracted from the supporting rail, the roller is first held by the resilient stop. When the roller is moved past the resilient stop, it comes to rest against the rigid stop. Thus, the center rail cannot be extracted unintentionally from the supporting rail. The roller may, however, be laterally moved through the opening, such that the center rail can be released from the supporting rail.

13 Claims, 17 Drawing Figures

EXTENSION PULL-OUT GUIDE ASSEMBLY FOR DRAWERS

FIELD AND BACKGROUND OF THE INVENTION

The invention relates to a pull-out guide assembly for use on ech side of a drawer and including a pull-out rail on the side of the drawer, a supporting rail on the side of the furniture body and a center rail with rollers mounted thereon, the supporting rail having stops for the rollers of the center rail, at least one of the stops being made of resilient material, such as rubber or plastics material, and the supporting rail having C- or U-shaped profile with a vertical flange projecting from a lower horizontal flange.

Due to the fact that pull-out guides of the afore-mentioned kind comprise on each side of the drawer a supporting rail on the side of the body, a center rail and a pull-out rail on the side of the drawer, the drawer can by means of the pull-out rails be fully extracted from the body of the piece of furniture. Thus, access to objects arranged at the very rear of the drawer is facilitated. The same system is also used in so-called suspended file cabinets. In this case, it is also required that the rearmost part of the drawer or file cabinet be easily accessible. An example is described in Austrian Pat. No. 375,252.

Pull-out guides of the afore-mentioned kind have the disadvantage that they may close unintentionally, i.e. the drawer slides at least partly back into the body of the piece of furniture.

SUMMARY OF THE INVENTION

It is the object of the invention to provide a pull-out guide assembly for drawers in which at least the center rail is locked when the drawer has been fully extracted, so that unintentional pushing-in of the center rail into the furniture body is avoided. Equally, it is not necessary to release locking means of any kind to be able to push in the center rail. Moreover, the center rail should be easily releasable without running the risk that the center rail would be unintentionally fully extracted from the supporting rail and, hence, drop to the floor.

The object according to the invention is attained in that a first stop means of resilient material is deformable and, hence, can be overrun or overrode by a roller of the center rail in the pull-out direction, and that a second stop means limits the extent of extraction.

It is advantageously provided that the first stop means includes two adjacently arranged stops of different hardness.

Due to this design, the user can easily extract the center rail beyond the first stop means, whereas further extraction of the center rail is effectively avoided by the second stop means. If the center rail is to be removed from the supporting rail, it is also possible to move the center rail with respect to the second stop means. The extracted center rail is locked between the two stops, but slight pressure is sufficient to be able to push in or insert the center rail. It is not necessary to release any mechanical locking means.

Resilient restraining members have been described in U.S. Pat. No. 4,121,878 and DE-AS 26 03 753, but they serve only to lock the drawer of a single pull-out guide in the inserted position.

It is advantageously provided that the stops are mounted on bolts or the like of the supporting rail and which project into holes of the stops, the cross-sections of the bolts having different dimensions. Thus, stops of different hardness are obtained in a simple manner.

The two stops may be formed at a common member.

One embodiment provides that the supporting rail has, in the extracting direction after the stop or stops, an opening arranged in a vertical flange projecting from a lower horizontal flange and giving passage to the roller of the center rail.

A further embodiment of the invention provides that the stops are arranged at an upper horizontal flange of the supporting rail.

A further embodiment of the invention provides that the first stop means is made as an integral piece with the second stop means which cannot be overrun by rollers. It is advantageously provided that one flap is bent downwardly and one flap is bent upwardly from the upper horizontal flange of the supporting rail, and that a stop body at which the two stop means are formed is held by such flaps.

BRIEF DESCRIPTION OF THE DRAWINGS

In the following embodiments of the invention will be described in more detail with reference to the accompanying drawings, in which.

DESCRIPTION OF THE PREFERRED EMBODIMENTS

Figure 1:
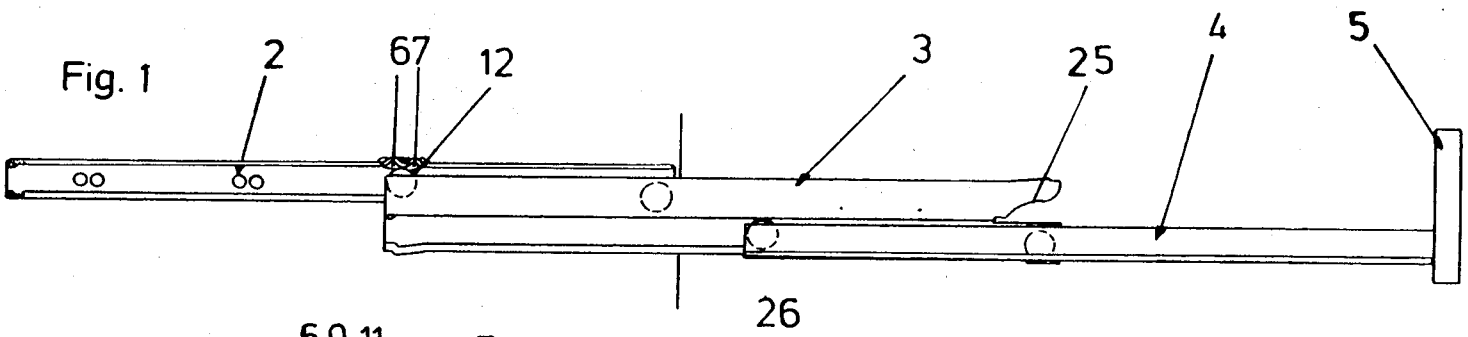
FIGS. 1, 7, 9 and 12 are side views complete pull-out guide assemblies of the invention.
Figure 2:
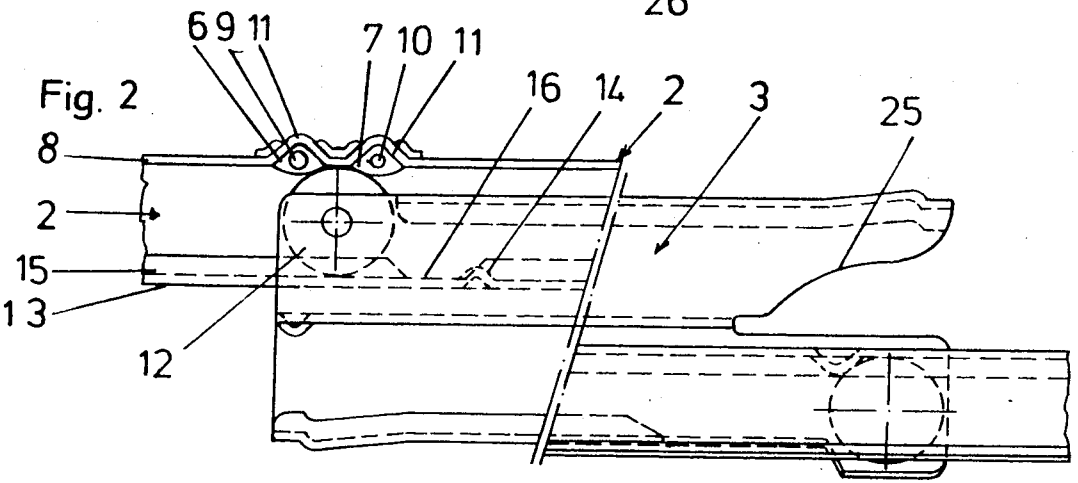
FIGS. 2, 3, 4, 5, 8, 10 and 13 are enlarged partial side views of stop regions of the assemblies.

The pull-out guide assembly according to the invention comprises in a conventional manner on each side of a drawer a supporting rail 2 on the side of a furniture body, a center rail 3 and a pull-out rail 4 on the side of the drawer. In FIGS. 1, 7, 9 and 12 the drawer is indicated only by the front cover member 5.

In the embodiment according to FIGS. 1 to 5, the supporting rail 2 has two stops 6, 7. The stops 6, 7 are made of resilient material, for example rubber or plastics material, and may be designed as one part or as separate parts. The supporting rail 2 has adjacent an upper horizontal flange 8 thereof bolts 9, 10 onto which the stops 6, 7 are mounted.

Furthermore, in the region of stops 6, 7 flange 8 is provided with angular portions 11 which embrace the upper parts of stops 6, 7 and thus provide better support for the stops 6, 7.

Figure 3:
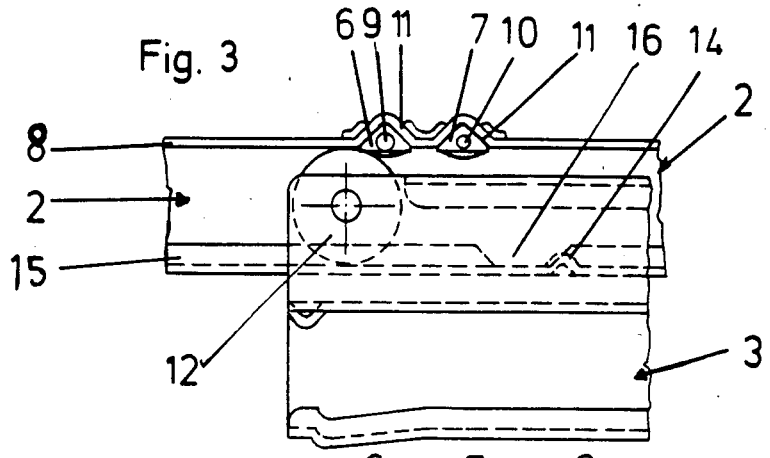
Figure 4:
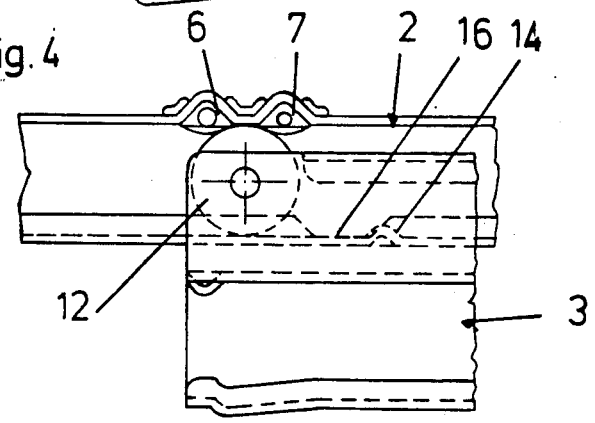
Figure 5:
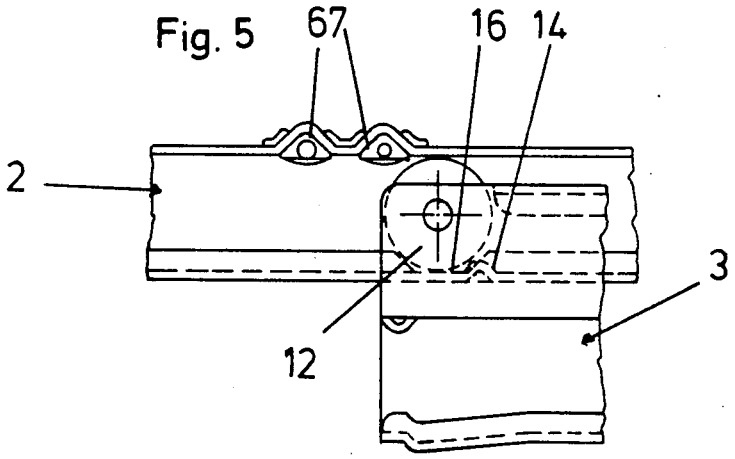
Figure 6:
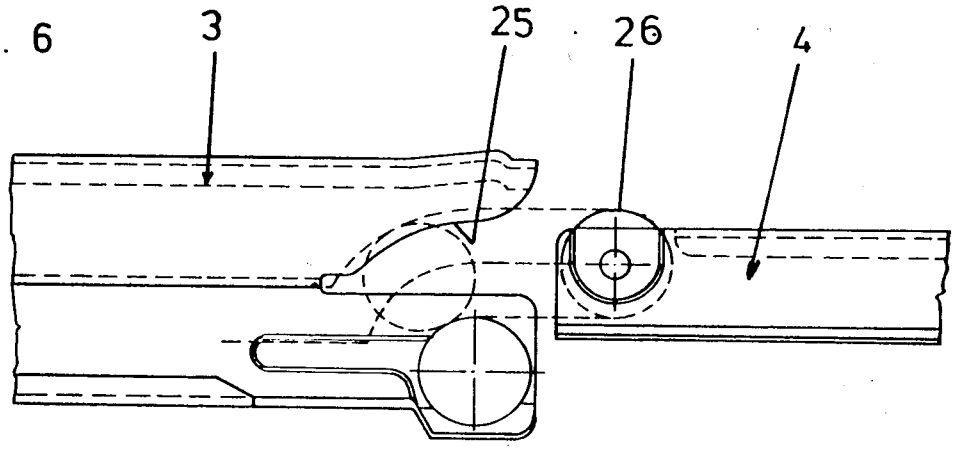
FIG. 6 is an enlarged side view illustrating the insertion of a pull-out rail into a center rail.

As can particularly be seen from FIGS. 3 to 5, bolt 9 has a greater diameter than bolt 10, and hence stop 6 consists of less resilient material than stop 7. As a result stop 6 produces greater resistance when a roller 12 of the center rail 3 is moved over it.

During normal operation of the pull-out guide assembly, the center rail 3 is extracted from the supporting rail 2 to such an extent that the roller 12 is forced past stop 6 but not past stop 7. The center rail 3 is thus held in such extracted position, and unintentional insertion is avoided.

When the center rail 3 is to be completely removed from the supporting rail 2, the roller 12 is moved past stop 7.

To prevent the center rail 3 from easily being extracted from the supporting rail 2 and hence the drawer from dropping to the floor, a stop 14 which cannot be overrun by the roller 12 is bent outwardly from a lower horizontal flange of the supporting rail 2.

The lower horizontal flange 13 which also forms the running flange of the roller 12 has a vertical flange 15 which guides the roller 12 over the full length of the supporting rail 2. Toward the front end of the supporting rail 2, adjacent the stop 14, the vertical flange 15 has an opening 16. The roller 12 can be laterally moved through opening 16.

Hence, the center rail 3 is laterally extractable from the supporting rail 2, but it cannot be extracted in the forward direction. This provides substantially greater security during operation of the pull-out guide assembly.

Figure 9:
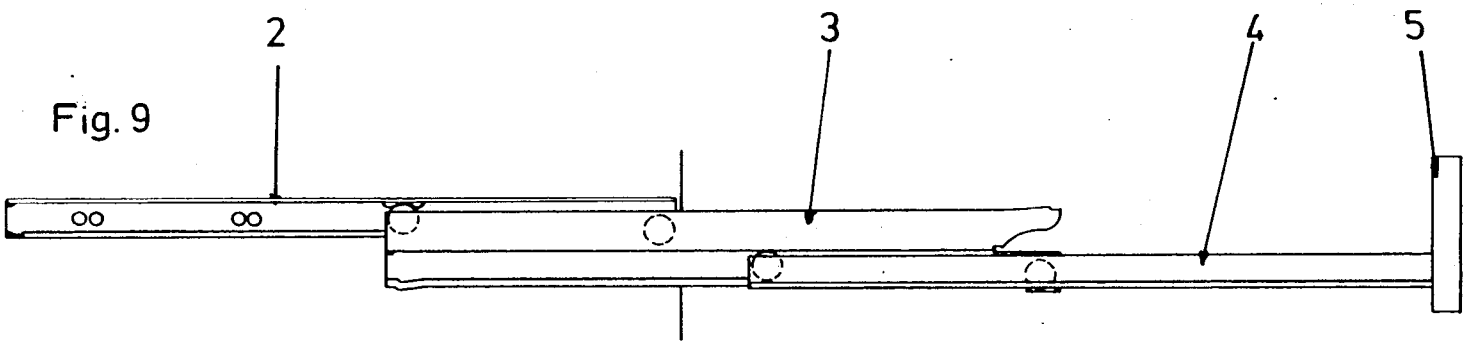
Figure 11:
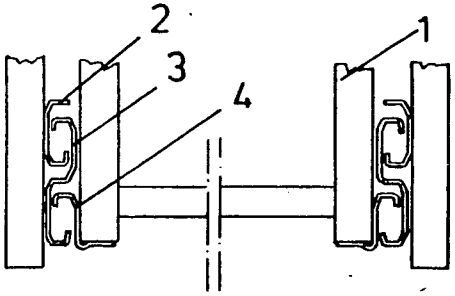
FIG. 11 is a schematic front view of a drawer.
Figure 10:
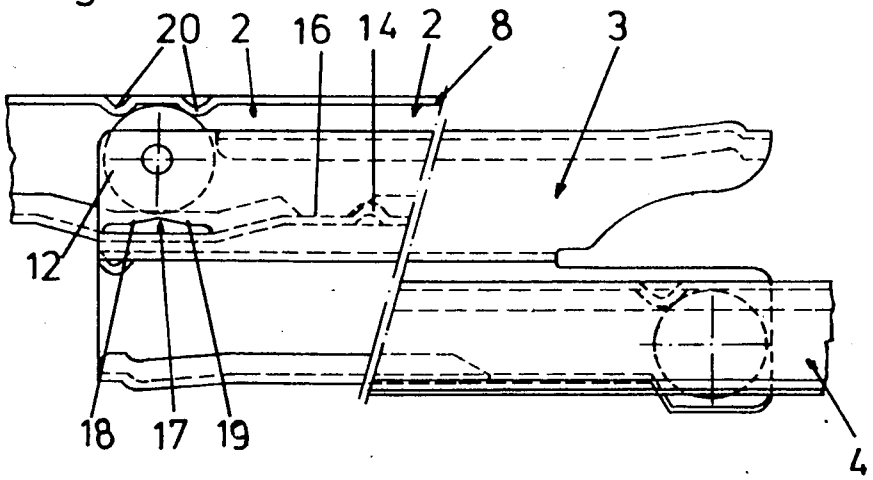
Figure 12:
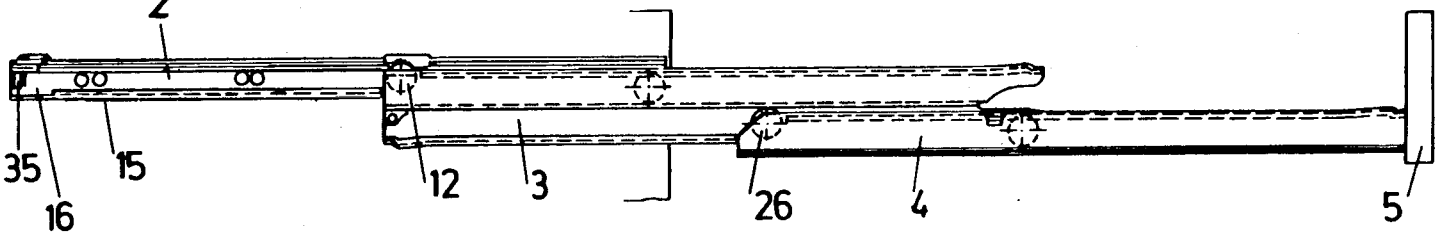
Figure 13:
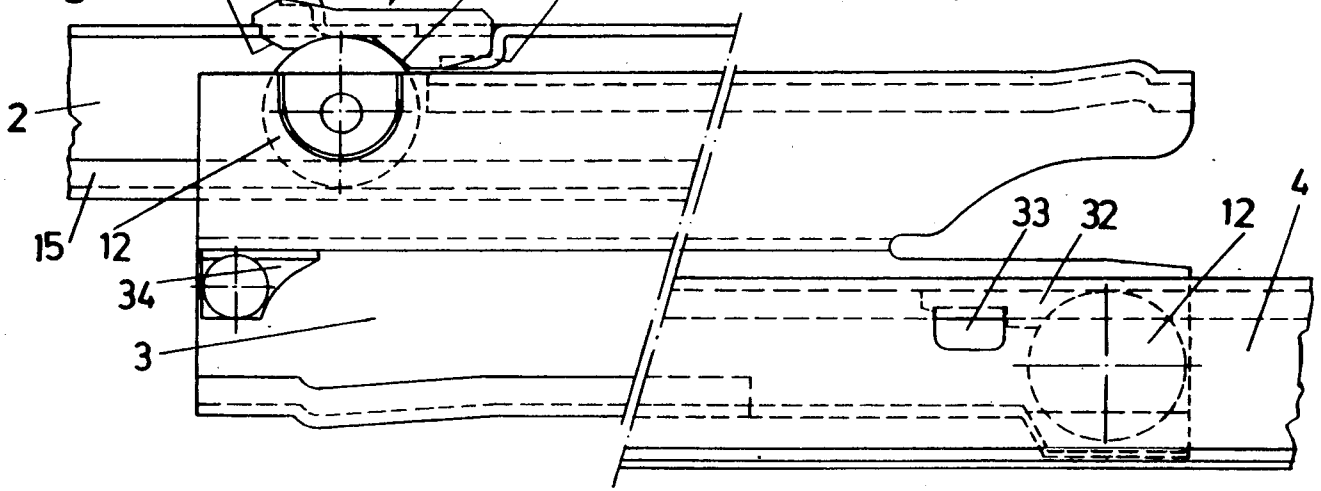
Figure 14:
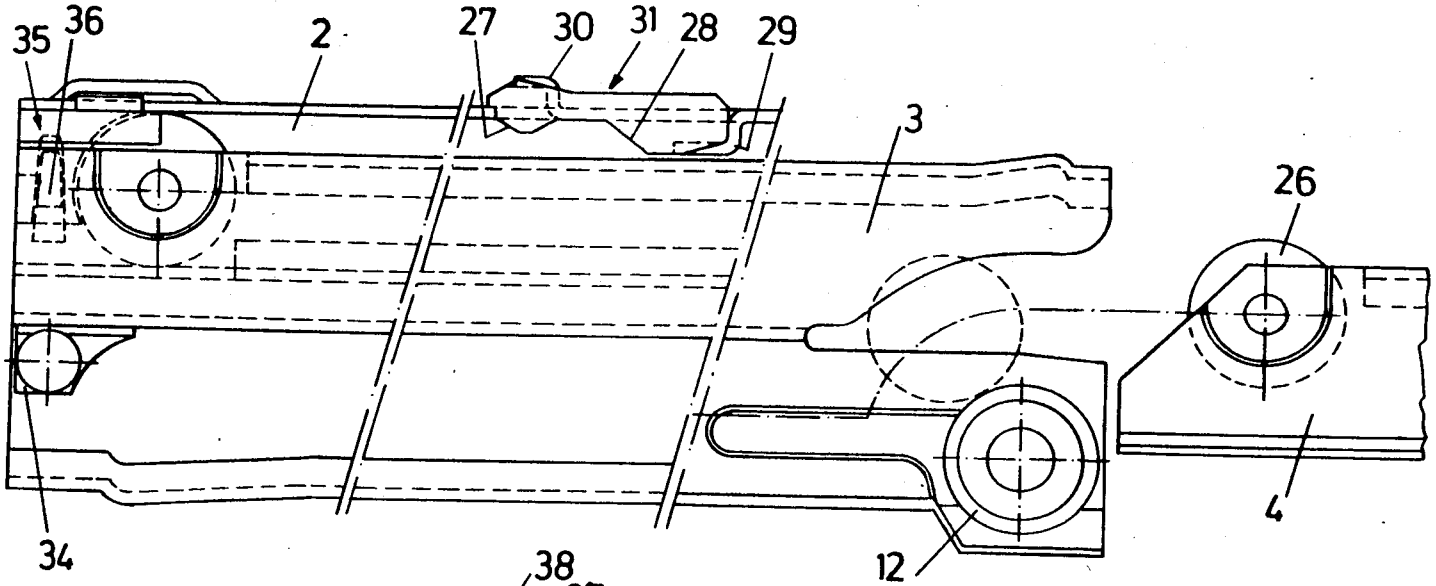
FIG. 14 is an enlarged side view of a supporting rail on one side of a furniture body and of a center rail in the inserted position.
Figure 15:
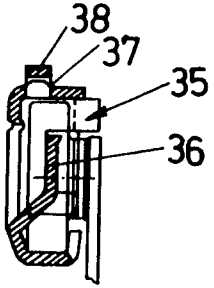
FIG. 15 is a sectional view along line XV—XV of FIG. 14.
Figure 16:
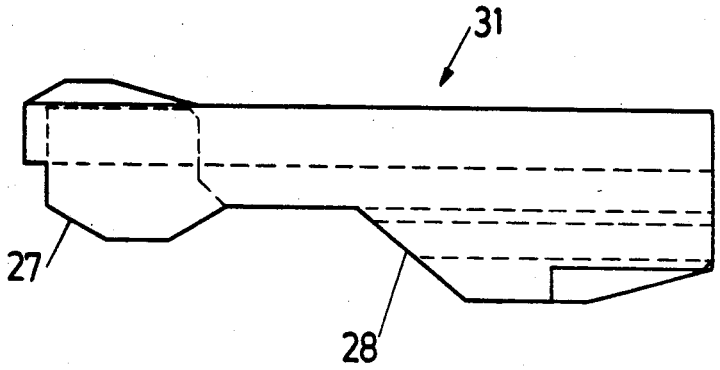
FIG. 16 is a side view of a stop body according to FIGS. 13 and 14.
Figure 17:
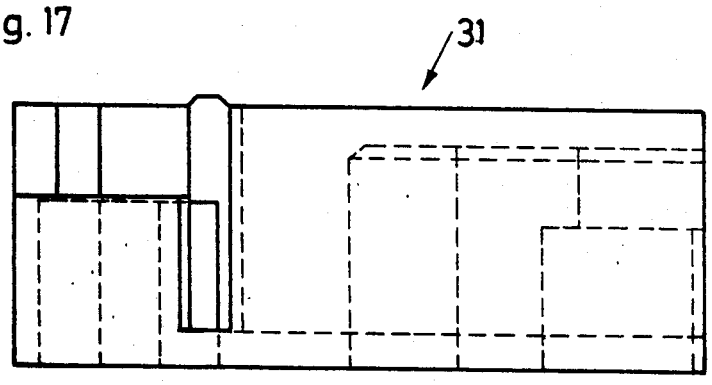
FIG. 17 is a top view of a stop body according to FIGS. 13 and 14.

In the embodiment according to FIGS. 9 and 10, a single resilient stop 17 is provided at the supporting rail 2. The stop 17 has an ascending face 18 and a descending face 19 with respect to the direction of extraction. The stop 17 is positioned at the lower horizontal flange 13 of the supporting rail 2, and the horizontal flange 13 is downwardly angled or depressed in the region of stop 17 (FIG. 10).

Two stops 20 are bent downwardly from the upper horizontal flange 8 at a position opposite the stop 17.

When the center rail 3 is extracted from the supporting rail 2, the roller 12 is, when running against the stop 17, pressed between the stops 20 by stop 17, and thus the center rail 3 is retained in such position.

When the center rail 3 is to be fully moved from the supporting rail 2, the roller 12 is passed below stop 20 shown on the right side of FIG. 10, which is possible because of the resilience of stop 17. Adjacent the front end of the supporting rail 2 there is also provided a stop 14 which cannot be overrun and which prevents the roller 12 from fully rolling out of the supporting rail 2. The opening 16 in the vertical flange 15 of the lower horizontal flange 13 is positioned directly in front of stop 14 so that the roller 12 can be laterally removed from the supporting rail 2, and the center rail 3 is released.

Figure 7:
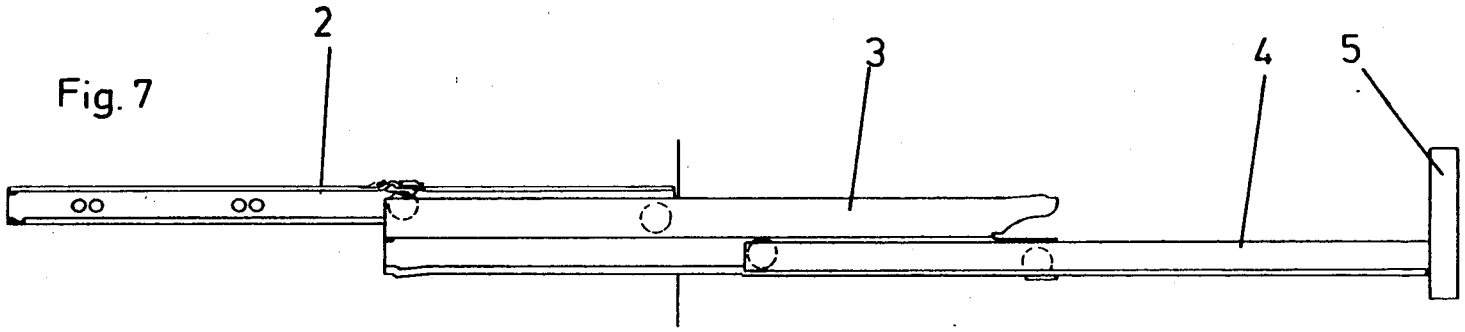
Figure 8:
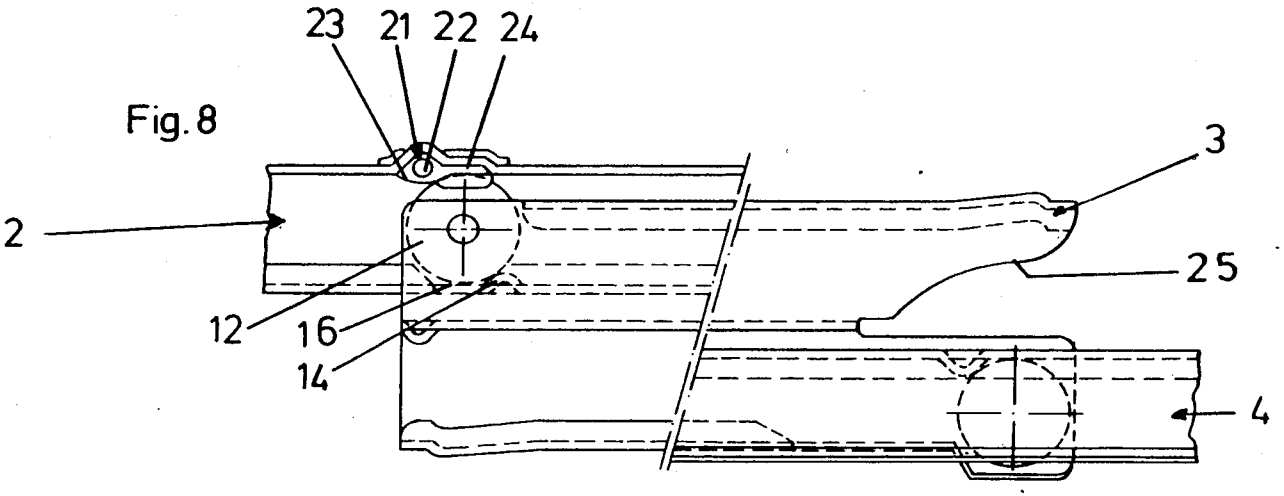

In the embodiment according to FIGS. 7 and 8, a single stop 21 of resilient material is provided at the horizontal flange 8 of supporting rail 2. Stop 21 is mounted on a bolt 22 of the supporting rail 2. The stop 14, which cannot be overrun by the roller 12, is arranged at the lower horizontal flange 13 opposite the stop 21, and an opening 16 is again provided in the vertical flange 15 in front of stop 14. When the center rail 3 is in the extracted position but not fully removed, the roller 12 is positioned between the resilient stop 21 and the stop 14. Stop 21 has a broader portion 23 and a narrower portion 24.

The broader portion 23 serves for the absorption of the extracting motion, when the drawer is pulled out. When the roller 12 is then moved past the stop portion 23, it is pressed against the stop 14 by the stop portion 24, and the center rail 3 is thus retained in such position. As in the afore-mentioned embodiments, the center rail 3 with the roller 12 may be romoved laterally of the supporting rail 2.

As can be seen from the drawings, the front end of center rail 3 is provided with a beak-like recess 25 which facilitates insertion of the pull-out rail 4 and a roller 26 mounted thereon.

In the embodiment according to FIGS. 12 to 17, a stop 27 of the supporting rail 2 adapted to be overrun by rollers is made in one piece with a terminal stop 28. In the extracted position, the center rail 3 is also held between stops 27, 28 by means of runner roller 12.

A stop body 31 carries stops 27, 28 and is fastened at the upper horizontal flange of the supporting rail 2. Flaps 29, 30 respectively extend downwardly and upwardly from such horizontal flange. The stop body 31 is pushed into the openings formed by flaps 29, 30 and is held by flaps 29, 30, both of which extend in the direction of insertion of the drawer.

As described in the afore mentioned embodiments, the stop body 31 is advantageously made of plastics material.

The rear half of pull-out rail 4 is provided with a stop 32 which is held by a flap 33 punched out of the pull-out rail 4. Stop 32 abuts against the front runner roller 12 of the center rail 3 when the pull-out guide assembly is in the fully extracted position.

The rear end of the center rail 3 is provided with a stop 34 against which the rear runner roller 26 of the pull-out rail 4 abuts when the pull-out guide assembly is in the inserted position.

The supporting rail 2 has a stop 35 at its rear end. The rear runner roller 12 of the center rail 3 abuts against stop 35 when the pull-out guide assembly is in the inserted position.

An opening 16 is arranged directly in front of stop 35 so that the center rail 3 can, if desired, be taken out laterally from the supporting rail 2.

The stop 35 is held by a flap 36 punched out of the supporting rail 2 and projects into a slot 37 in the upper horizontal flange of the supporting rail 2 which is formed by a punched member 38.

What is claimed is:

1. A guide assembly for use on each of opposite sides of a drawer of the type wherein the drawer is slidably insertable in an insertion direction into and removable in a withdrawal direction from a body, said assembly comprising:

a pull-out rail to be mounted on a drawer;

a supporting rail to be mounted on a side of a body, said supporting rail including a lower horizontal flange having extending upwardly therefrom a vertical flange;

a center rail mounted between said pull-out and supporting rails and having rollers rollingly contacting said supporting rail;

first stop means on said supporting rail for contacting one of said rollers when the drawer is in a withdrawn position to prevent unintentional insertion of the drawer into the body from said withdrawn position, said first stop means being formed on a resilient material that is sufficiently deformable to enable said one roller to overrun said first stop means; and second stop means on said supporting rail for limiting movement of said one roller and said center rail in said withdrawal direction and which cannot be overrun by said one roller.

2. An assembly as claimed in claim 1, wherein said first stop means comprises two adjacently positioned stops.

3. An assembly as claimed in claim 2, wherein said two stops are of different hardness.

4. An assembly as claimed in claim 3, wherein said two stops are mounted on said supporting rail by two bolts extending into respective holes in said stops, said bolts having different cross sectional dimensions.

5. An assembly as claimed in claim 2, wherein said two stops are formed on a common member fastened to said supporting rail.

6. An assembly as claimed in claim 1, wherein said vertical flange has formed therein an opening at a position downstream of said first stop means in said withdrawal direction, such that said one roller can be removed from said opening laterally of said supporting rail.

7. An assembly as claimed in claim 1, wherein said supporting rail includes an upper horizontal flange, and said first stop means is on said upper horizontal flange.

8. An assembly as claimed in claim 1, wherein said lower horizontal flange of said supporting rail has a downwardly depressed portion, and said first stop means is located in said downwardly depressed portion.

9. An assembly as claimed in claim 8, wherein said supporting rail includes an upper horizontal flange having bent downwardly therefrom two stops at a position confronting said first stop means.

10. An assembly as claimed in claim 1, wherein said first and second stop means are formed integrally.

11. An assembly as claimed in claim 10, wherein said supporting rail includes an upper horizontal rail, and said first and second stop means are defined on a stop body mounted on said upper horizontal flange.

12. An assembly as claimed in claim 11, wherein said upper horizontal flange includes an upwardly bent flap and a downwardly bent flap, and said stop body is supported by said flaps.

13. An assembly as claimed in claim 12, wherein said flaps extend in said insertion direction.

* * * * *